US005108257A

United States Patent [19]

Fukazawa et al.

[11] Patent Number: 5,108,257

[45] Date of Patent: Apr. 28, 1992

[54] IMPELLER FOR TURBO PUMP FOR WATER JET PROPULSION MACHINERY, AND TURBO PUMP INCLUDING SAME IMPELLER

[75] Inventors: Tetsuo Fukazawa, Tokyo; Makoto Toyohara, Hamamatsu, both of Japan

[73] Assignees: Pacific Machinery & Engineering Co., Ltd., Tokyo; Sanshin Industries Co., Ltd., Shizuoka, both of Japan

[21] Appl. No.: 749,481

[22] Filed: Aug. 15, 1991

[30] Foreign Application Priority Data

May 26, 1989 [JP] Japan ..... 1-131576

[51] Int. Cl.[5] ..... F04D 29/22; F04D 29/44

[52] U.S. Cl. ..... 415/182.1; 415/183; 416/188; 416/223 B

[58] Field of Search ..... 416/176, 177, 179, 182, 416/185, 188, 223 B, 180, 223 R; 415/182.1, 183, 208.1, 211.2, 225

[56] References Cited

U.S. PATENT DOCUMENTS

| | | | |
|---|---|---|---|
| 1,795,588 | 3/1931 | Wilson | 415/182.1 X |
| 2,446,879 | 8/1948 | Kennedy | 415/182.1 X |
| 2,941,780 | 6/1960 | Von Der Nuell et al. | 416/182 |
| 3,013,501 | 12/1961 | Ygge | 416/185 X |
| 3,187,708 | 6/1965 | Fox | 415/183 X |
| 3,306,046 | 2/1967 | Trapp | 415/211.2 |
| 3,635,579 | 1/1972 | Wood | 415/182.1 |
| 3,644,056 | 2/1972 | Wiselius | 416/176 X |
| 3,737,249 | 6/1973 | Cooper | 416/176 X |
| 3,904,306 | 9/1975 | Navelsaker | 416/184 X |
| 4,708,585 | 11/1987 | Fukazawa et al. | 415/72 |

*Primary Examiner*—Edward K. Look
*Assistant Examiner*—James A. Larson
*Attorney, Agent, or Firm*—Kane, Dalsimer, Sullivan, Kurucz, Levy, Eisele and Richard

[57] ABSTRACT

A turbo pump is provided with an impeller having a volute casing for a diffuser type casing. The configuration of a meridian section of the impeller shroud at the side of a boss is made as a concave arch-like surface of revolution. The shroud at the side of the blade inlet is cylindrical and substantially parallel to the shaft about which the impeller turns. Each of the blades of the impeller is so shaped that the edge of the blade inlet projects toward the impeller eye and is smoothly connected to the surface of the shroud. The inlet angle of the blade is as small as possible.

6 Claims, 13 Drawing Sheets

IMPELLER FOR TURBO PUMP FOR WATER JET PROPULSION MACHINERY, AND TURBO PUMP INCLUDING SAME IMPELLER

This is a continuation of copending application Ser. No. 07/523,667 filed on May 15, 1990, abandoned

BACKGROUND OF THE INVENTION

The present invention relates to an impeller for a turbo pump provided with a volute casing or a diffuser-type casing, for a water jet propulsion machinery mainly used as propulsion means for ships. The invention also relates to a turbo pump including the impeller.

Since a water jet propulsion system for propulsion means for ships, in which a turbo pump is used, has been hitherto regarded as lower in the efficiency of propulsion than a propulsion system using a propeller, it has not been generally used. Only for safety reasons, the water jet propulsion system is used to propel a smaller sized ship for leisure for which the efficiency of propulsion is not so much important. Under existing circumstances, as a result of theoretical studies, trial manufacture and experiment, it has merely turned out that the propulsion efficiency of the water jet propulsion system can be made higher than that of a conventional propeller propulsion system in use so far as a high-speed ship is concerned.

A turbo pump in the water jet system is used in an arrangement as shown in FIG. 1. In operation, water is sucked in through an intake port A, increased in pressure by the pump, and discharged in the form of jet at a speed $V_j$ from a nozzle B, to thereby propel the ship by the reaction to the discharge. The characteristic of the jet from the nozzle B is determined depending on the cross-sectional area of the nozzle, and is shown by a curve J in FIG. 2 which is a graph with the axis of abscissa for the flow rate Q of jet and the axis of ordinate for the pressure energy (water head) H.

The characteristics of the water jet propulsion system when the ship shown in FIG. 1 is travelling, will be now described with reference to FIG. 2. When the engine of the ship is started to operate the pump and the water jet is discharged from the nozzle B, the flow of the water in the pipe between the intake port A and the outlet nozzle B has a characteristic shown by the nozzle characteristic curve J in FIG. 2. The operating point moves on the curve J, according to the speed of the ship, from the origin (Q=0, H=0) shown in FIG. 2 which indicates a state of the stoppage of the ship, to the direction, as shown by an arrow in FIG. 2.

Hereupon considering the pressure (water head) $H_1$ at the point C immediately before the nozzle B when the engine (or the turbo pump) is driven at a prescribed number of revolution and the ship is restrained from moving, it is indicated by a characteristic curve $H_1$ dependent on the inclination of a pump head curve which is provided by subtracting the sum of all the pressure loss head in the pipe between the intake port A and the nozzle B from the head curve of the turbo pump. The intersecting point $Q_1$ of the characteristic curve $H_1$ with the nozzle characteristic curve J provides the point of operation of the water jet. When the ship is then freed from the restraint and travelled, dynamic pressure resulting from the speed of the ship acts on the intake port A so that the pressure head $H_1$ at the point C immediately before the nozzle B moves, on the nozzle characteristic curve J, from the point $Q_1$ to a point $Q_1'$ at which a thrust corresponding to the resistance to the travel of the ship is produced, whereby the characteristic curve $H_1$ rises to that of $H_1'$. The pressure head of the share of such rise from the level of the characteristic curve $H_1$ to that of the upper one $H_1'$ corresponds to the dynamic pressure $V_s^2/2g$ wherein $V_s$ and g denote the speed of the ship and the acceleration of gravity, respectively. Accordingly, the pressure $H_1'$ at the point C immediately before the nozzle C during the travel of the ship can be calculated in accordance with a following equation (1).

$$H_1' = H - h_L + \frac{V_s^2}{2g} \tag{1}$$

wherein H: head of the pump (m), $h_L$: sum of many kinds of pressure losses of head such as the friction loss in the pipe between the inlet A and the nozzle B (m), $V_s$: speed of the ship (m/s).

Although the design of a pump must be effected by using the flow rate $Q_n$ at the point $Q_1'$, it is mostly designed by using the flow rate $Q_n'$ at a point P or a point P', which is smaller than $Q_n$, because it is difficult to presume the resistance to the hull of the ship when it is travelling and estimate the pressure loss of head in the pipe between the inlet A and the nozzle B. If the turbo pump having the flat inclination of the pump head curve used in the jet propulsion system is designed by the use of the flow rate $Q_n'$, the characteristic curve of the pressure head $H_2$ immediately before the nozzle B is flatter in inclinatin than that of the pressure head $H_1$. In that case, the point of operation when the ship is travelling is denoted by $Q_2'$ as shown in FIG. 2.

The thrust T when the ship is travelling is calculated in accordance with a following equation.

$$T = \rho \cdot Q_P (V_j - V_s) \tag{2}$$

wherein T: Thrust (kgf), $\rho$: Density of the water (kgf.s$^2$/m$^4$), $V_j$: Jet speed (m/s), $Q_p$: Flow rate of the pump at the point P (m$^3$/s).

The jet speed $V_j$ is calculated in accordance with a following equation.

$$V_j = \alpha \cdot \sqrt{2g(H + H_{sv})} \tag{3}$$

wherein $H_{sv}$: Effective recovered dynamic pressure $$= \frac{V_s^2}{2g} - h_L$$

$\alpha$: Coefficient.

As apparent from the equations (2) and (3), it is understood that the thrust T is proportional to the flow rate of the turbo pump and increases nearly in proportion to the square root of the pump pressure. This means that the more the nozzle characteristic J advances to the direction of arrow-mark, the more the thrust increases. Accordingly, the flatter the head characteristic of the pump used for the jet propulsion system is, the more the intersecting point with the nozzle characteristic J moves toward the side greater in flow rate Q and the thrust is increased, thereby permitting increase in the speed of the ship. Conversely speaking, such pump may be also applied to a widely used hull of greater resistance and an estimated margin for the resistance to the hull of the ship, the pressure loss in pipe line and so forth can be made greater, with the result that the allowable tolerances in the design of the water jet propulsion system are in a wide range.

In the water jet propulsion system, it is on the other hand necessary for improvement of the propulsion efficiency that the turbo pump is directly coupled to the engine to make the speed of the pump as high as possible, and a reduction gear or the like between the engine and the pump is eliminated to reduce the size and weight of the entire propulsion system. However, since the pump head is proportional to the square of the number of revolution rather than to the law of pump similarity, the higher the speed of the pump is made, the farther the pump is apart from the aformentioned requirement of flattening the head curve of the pump. Besides, the jet propulsion system requires a high-specific-speed pump of higher flow rate and lower head. Since the head characteristic of such high-specific-speed pump has a greater inclination going down to the right than some of the turbo pumps, the higher speed of the pump results in the characteristic curve having an extremely greater slope going down to the right, so that the higher speed of the pump cannot be achieved. Moreover, even if such general high-specific-speed pump is designed to be rotated at a lower speed, the pump has generally the following features and undesirable properties for the water jet propulsion system.

(1) The slope of the head curve of the pump going down to the right is large.

(2) The efficiency of the pump is considerably low if it is driven away from the point of the maximum efficiency thereof.

(3) At the excessive flow rate beyond the maximum efficiency of the pump, cavitation is likely to occur, thereby resulting in the sharp drop of the efficiency.

SUMMARY OF THE INVENTION

This invention has been developed for the purpose of obviating the aforesaid disadvantage of the prior art.

Accordingly, it is an object of the present invention to provide an impeller for a turbo pump in a water jet propulsion machinery, including mutually contradictory features that while it is a high-specific speed pump, the higher speed of the pump can be promoted and the head curve of the pump is flattened.

The design of such turbo pump provides an optimum turbo pump for the water jet propulsion machinery. In other words, when it is possible to design the pump having a head curve of flattened characteristic in spite of high specific speed and higher speed rotation pump, the shaft power curve also varies flatly with the head characteristic and therefore the efficiency characteristic of the turbo pump is also widened, thereby eliminating the above-mentioned three drawbacks of the high-specific-speed pump obtained from conventional design methods and unsuitable for the water jet propulsion machinery and improving the propulsion efficiency of the water jet propulsion machinery.

In order to achieve the above-mentioned object, there is provided an impeller for a turbo pump in a water jet propulsion machinery used as propulsion means for ships having a volute casing or a diffusion type casing, wherein the configuration of meridian section of an impeller-shroud at the side of a boss is made as a concave arc-like surface of revolution, said boss shroud at the side of the blade inlets being formed in a cylindrical form substantially parallel to a rotary shaft, and each of the blades of the impeller is so shaped that the edge of the blade inlet projects greatly toward the impeller eye with said edge being smoothly connected to the surface of said boss shroud at the blade inlet side and the edge of the blade inlet at the side of the casing extends substantially perpendicularly to the axis of rotation, said edges of the blade inlet at either of the boss and casing sides being connected by a smooth arc-like curve projecting convexly upstream to thereby form a continous edge of the blade inlet, and the inlet angles of said edges of the blade inlet being uniform through the entire length and set to an angle nearer to 0° as small as possible, and said configuration of the blade at said blade inlet being connected by a smoothly curved surface to the configuration at the end of the blade outlet shaped as centrifugal or mixed flow type extending parallel or inclined to the rotary shaft.

The impeller shaped as described above provides the technique for manufacturing a pump as a high-speed centrifugal pump which has a volute casing or a diffuser-type casing with the pump characteristic in the region of a mixed-flow pump or an axial-flow pump as that equal to the centrifugal type pump. When such centrifugal pump is used as turbo pump for the water jet propulsion machinery, the efficiency of the characteristic of the water jet propulsion machinery is greatly improved. This means that the turbo pump can be also used for general purpose in the industry and makes it possible to use the turbo pump in a field in which use of a conventional turbo pump was impossible, as in the example mentioned later. The turbo pump provided in accordance with the present invention has therefore considerably high utility value.

Furthermore, it is preferable to include stationary inlet guide vane means provided upstream to said impeller or in the vicinity thereof, said means having a plurality of stationary inlet guide vanes made of sheets, the configuration of each of said guide vanes being either of forced prerotation normal type adapted to guide the inlet flow in the direction of revolution of the impeller or of forced prerotation opposite type adapted to guide the inlet flow oppositely to the direction of revolution of the impeller.

The provision of stationary inlet guide vane means as mentioned above permits the flow of the water to be smoothly rectified and enter the blade inlets, so that the inflow loss at the blade inlets is considerably reduced in cooperation with the configurations of the blade inlet of the impeller, thereby improving the performance of the turbo pump to bring about the increase in the jet thrust of the water jet propulsion machinery.

The provision of a rectifier means for rectifying the flow toward the nozzle in a throat of the volute casing permits the diameter and length of the throat of the volute casing to be minimized to thereby design the turbo pump compactly as a whole, at the same time the speed of the ship can be increased in comparison with the pump having no flow rectifier therein. Such design technique can be also applied to a pump for general purpose in the industry.

When the shroud of the impeller as stated in claim 1 has an opening between each pair of mutually neighboring blades so that it is shaped as star-like open type shroud, the thrust of the shaft of the turbo pump can be balanced without deteriorating the performance thereof, which is convenient for the higher speed and higher head of the turbo pump. Such a turbo pump with the construction as mentioned above can be not only used for the pump in the water jet propulsion machinery but also used as a smaller sized high-speed and high head turbo pump for a pump for general industry.

DETAILED DESCRIPTION OF EXEMPLARY EMBODIMENTS

Embodiments of the present invention are hereafter described in detail with reference to the drawings attached thereto.

Figure 4:
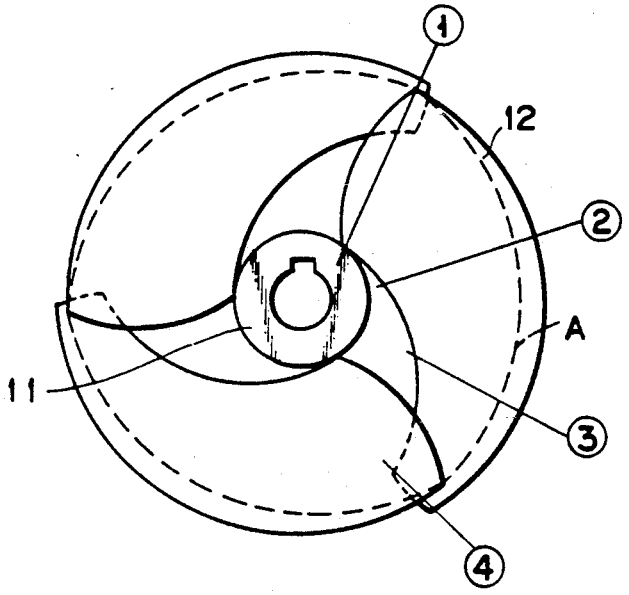
FIG. 4 is a front view of an impeller of an embodiment of the invention.
Figure 4A:
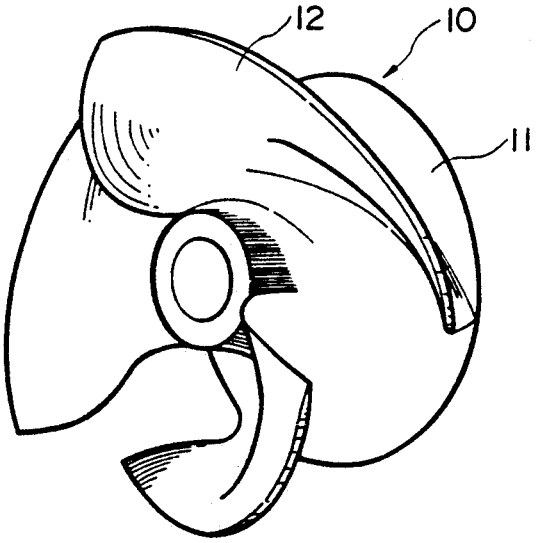
FIG. 4*a* is a perspective view of the impeller shown in FIG. 4.

FIG. 4 is a front view of one embodiment of an impeller according to the invention, which represents the form of the impeller as viewed along the rotary shaft.

Figure 5:
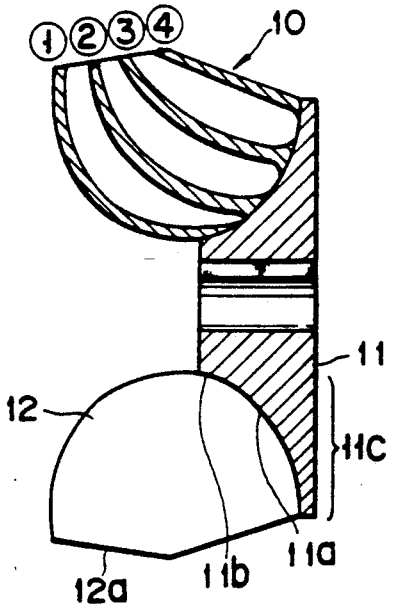
FIG. 5 is a longitudinal sectional view taken along the central axis of the impeller in FIG. 4.

FIG. 5 illustrates a meridian section of the impeller along the axis of rotation thereof. The upper half of FIG. 5 is a view showing the configuration of the blade of the impeller, in which the configuration in section of each blade from the blade inlet to the blade outlet in positions of ① to ④ in FIG. 4 are illustrated in the meridian sections.

Generally speaking, in order to produce the turbo type impeller having the above-mentioned flat head characteristic in spite of a high specific speed and higher speed revolution pump, it is necessary to make the direction of the flow of water at the blade outlet of the impeller perpendicular to the rotary shaft. The above-mentioned flow may be realized without depending on the specific speed (Ns value) of the pump in such a way that the blade is shaped so that the water flowing into the blade in the axial direction of the impeller is changed in the direction of flow inside the blade and is flown out at the blade outlet nearly perpendicularly to the axial direction, and according to such change in the direction of flow, a shroud 11*c* disposed or attached to a generally cylindrical boss 11 of the impeller 10 is in the form of elbow which causes the water to flow outwardly under the minimum resistance as shown in FIG. 5. The shroud 11*c* has a meridian surface 11*a* in the shape of a surface of revolution of a concave arc-like curve. This surface of revolution may be constituted by a quadratic curve such as a circle, a parabola, a hyperbola, or by another smoothly continuous curve.

Figure 1:
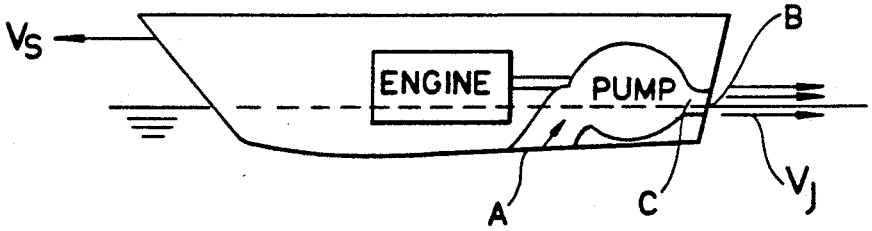
FIG. 1 is a view for explaining a propulsion system for ships in which a turbo pump is used for a water-jet propulsion system for ships.
Figure 2:
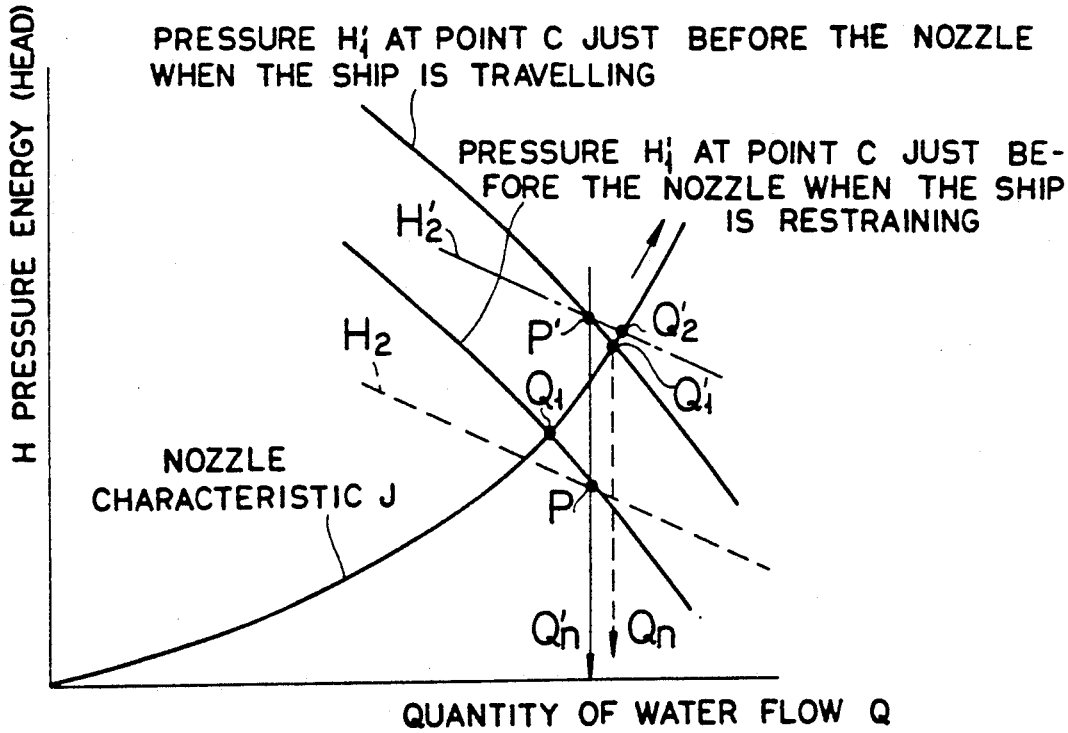
FIG. 2 is a graph indicating the jet propulsion characteristics of the ship having the turbo pump in FIG. 1 when the ship is travelling and restraining.
Figure 3:
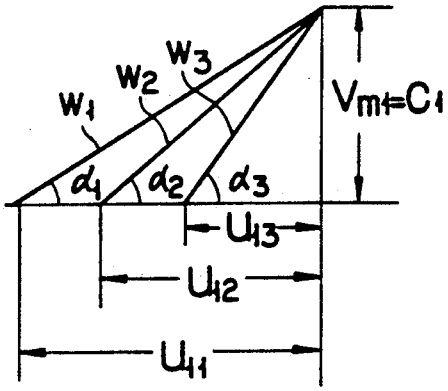
FIG. 3 is a velocity diagram at a blade inlet for explaining a procedure of designing the edge of a blade inlet of a conventional impeller.

As for the design of an impeller for a pump, it has hitherto been believed that the design in which the angle at the blade inlet is varied so that the meridian or absolute inflow velocity $V_{ml}$ becomes the same in all the edges of the blade inlet as shown in FIG. 3, provides the minimum loss at the blade inlet. When the speed of the pump is made higher by driving the pump through direct coupling to an engine or through the like, the configuration of the blade inlet according to the conventional design causes the peripheral velocity $u_1$ of the blade inlet to greatly increase along with the increase in radius, so that the smaller the radius is, the more sharply the inflow angle of the blade increases, which results in the configuration of the blade inlet considerably curved three-dimentionally. However, when the velocity of the pump impeller in the configuration of the blade inlet according to the conventional design is made higher, the uniform meridian inflow velocity $V_{ml}$ is not provided actually, because of the presence of the offset in the flow at the blade inlet, which results in the increased loss at the blade inlet, the likely occurrence of cavitation with the drop of pressure and consequently the lowering of efficiency.

The configuration of the blade inlet for preventing drawbacks of the conventional design caused in making the speed of the pump higher is provided by the concave arc-like curve of the surface 11*a* in the impeller 10. Adjacent to the blade inlet, surface 11*c* is cylindrical and substantially parallel to the rotary shaft, as at 11*b*. The inlet edge ① of the blade 12 is smoothly continuous from the boss 11 toward the casing. The angle (designated by "α" in FIG. 3) of the blade inlet which is substantially same in all the positions of the inlet edge ① of the blade and is set to an angle near to 0° as small as possible (i.e. tangent to the outer periphery of boss 11). As shown in the drawings, the continuous inlet edge of the blade is substantially perpendicular to the impeller shaft at the casing, and is connected at the casing and the shroud by a smooth arc-like curve projecting convexly upstream. Furthermore, while the ordinary pump has at the inlet of the impeller a corner at the intersecting point of a boss shroud with the pressure surface of the blade, the blade inlet formed as in the present invention provides, as shown in the section ① in FIG. 5, the configuration of the edge of the blade inlet substantially forming a part of a circle, with the corner at the intersecting points of the pressure surface at the blade inlet with the shroud being removed completely. Consequently in the pump for higher revolution using the impeller of the present invention, the front half of the blade of the impeller is capable of functioning similarly to an inducer, thereby providing not only the remarkably improved performance of cavitation but also the minimized loss at the inlet of the impeller.

In FIG. 5, the form of the blade outlet is such that the blade 12 having a section of the configuration ① of said blade inlet is linked by a smooth curve surface with the configuration ④ of the blade outlet parallel to the rotary shaft (not shown) or inclined with respect to the rotary shaft, which provides such a configuration that the change in the direction of the flow and the conversion to pressure caused thereby are effected with the minimum loss inside the impeller 10 as the flow advances from the inlet to the outlet of the blade 12, together with the above-mentioned form of the shroud 11*c* at the boss side. The impeller in the configuration mentioned above enables the pump to revolve at higher speed, and the flow in the impeller can be made to that in a pump of the type of increase in the rate of relative velocity of flow to peripheral speed, thus providing the pump which is higher in efficiency than that of a conventional pump and which is most suitable to the water jet propulsion system with characteristic nearer to a radial flow impeller having a flat head curve despite the high specific speed pump.

Figure 15:
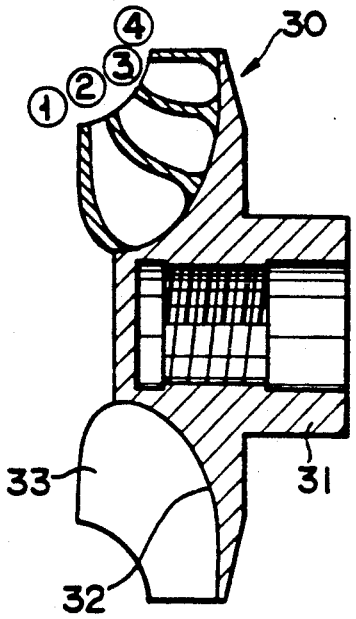
FIG. 15 is a sectional view of another embodiment of an impeller according to the present invention.
Figure 15A:
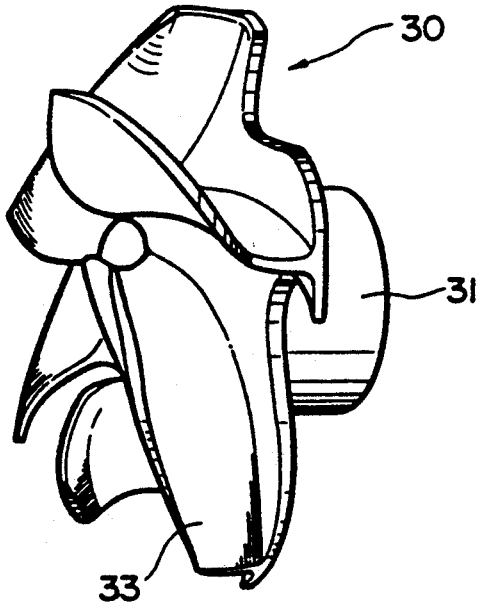
FIG. 15*a* is a perspective view of the impeller shown in FIG. 15.

Although the form 12*a* of the impeller at the casing side is defined using straight line as shown in FIG. 5, it may be the form of a surface of revolution of an arc-like curve as shown in FIG. 15 illustrating another embodiment.

Figure 6:
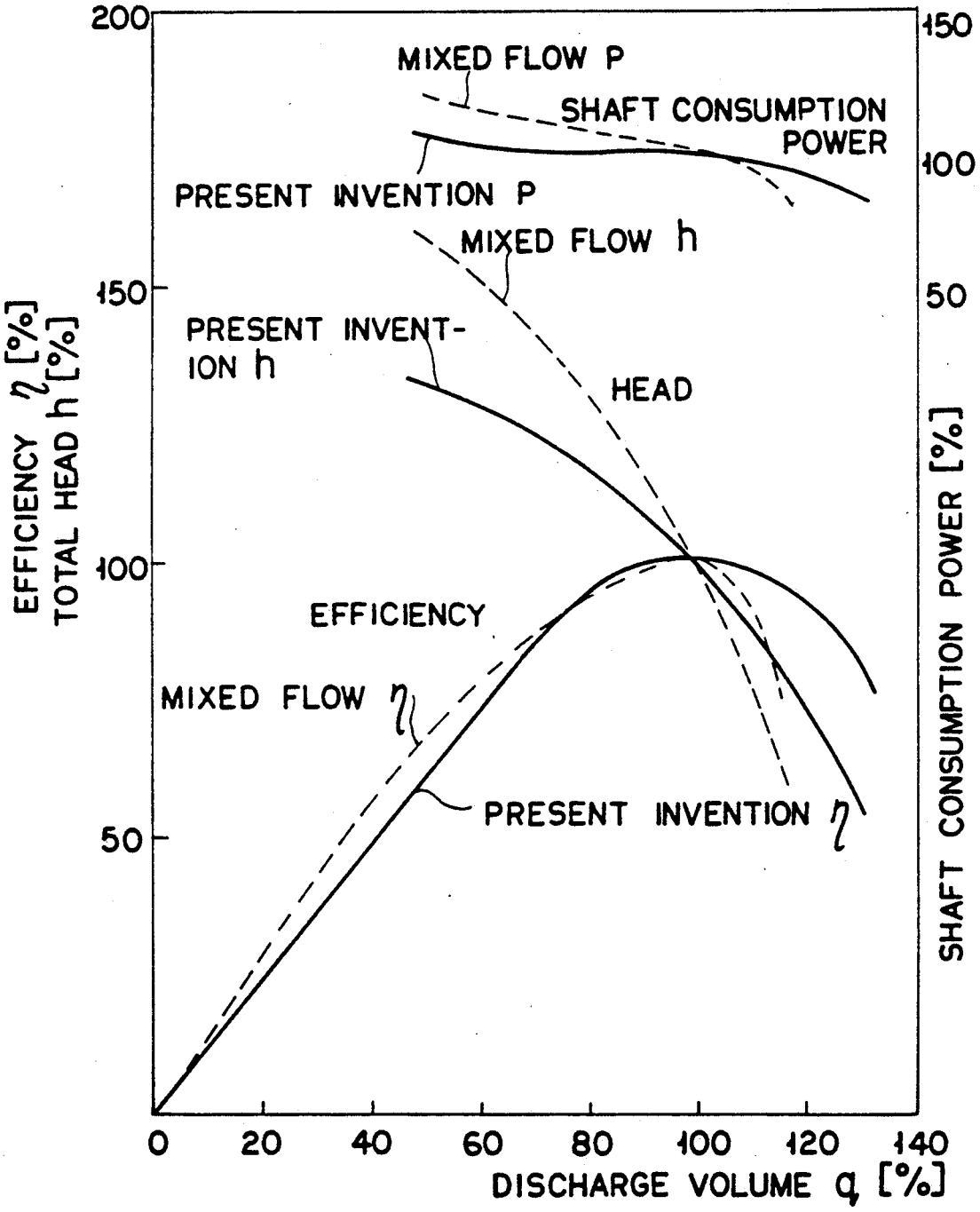
FIG. 6 is a graph for comparing the characteristics of a pump including the impeller according to the invention with those of a mixed-flow pump based on the conventional design.

FIG. 6 is a graph for comparing the characteristics (full lines) of a turbo pump including the impeller according to the invention, with those (dotted lines) of a mixed-flow pump based on conventional design methods. The impeller according to the invention was manufactured to correspond to the mixed-flow pump having a specific speed of 900 ($m.m^3$/min. r.p.m.). As a result, in the turbo pump having the impeller of the invention produced with the configuration of the blade as mentioned above, a specific speed of 1100 was obtained and as shown in FIG. 6, the head curve is flatter than that of the mixed flow pump and indicated the characteristic nearer to a radial flow type impeller lower in specific speed than the mixed flow pump. Besides, since the power characteristic curve also showed a flat curve nearer to a radial flow type pump, the efficiency curve became a wider and flatter one, which provides a better efficiency curve in a wider range of flow rate than that of the mixed-flow pump. This also proves that the turbo pump including the impeller of the invention is most suitable to a water jet pump.

Furthermore, the above-mentioned characteristics are the ones very useful as a high-speed turbo pump for general industry.

Figure 7:
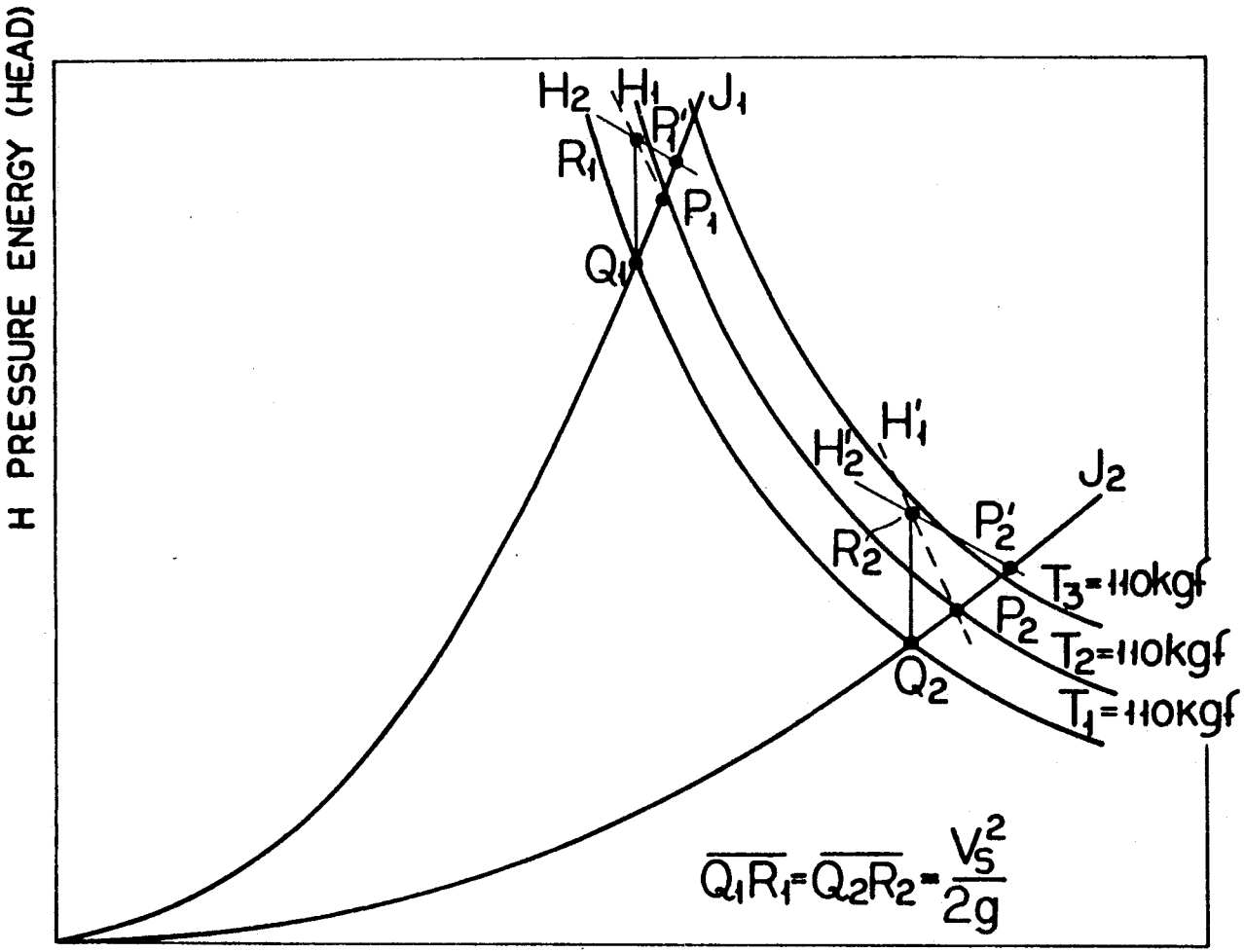
FIG. 7 is a graph for explaining how the inclinations of pump head characteristic curves due to the difference in nozzle characteristic affect the thrust.

In FIG. 7, in which a nozzle characteristic in the case of a smaller nozzle diameter at the outlet of the jet propulsion system is indicated by $J_1$ and that in the case of greater nozzle diameter $J_2$, a constant curve of thrust T described therein is shown by curves $T_1$, $T_2$ and $T_3$. The constant thrusts $T_1$, $T_2$ and $T_3$ designate static thrusts calculated in accordance with the equation (2) on condition that the speed $V_s$ of the ship is zero. It is considered that the travelling characteristics of the jet propulsion systems including pumps different from each other in the head characteristic, supposing that the respective speeds of the ships when travelling are equal, with intersecting points of the nozzle characteristic curves $J_1$ and $J_2$ with the thrust curve $T_1$ as the operation points when the ship is restrained from moving, the thrust when the ship is travelling shifts to the direction of greater flow rate. In this case, it is understood that the curve $J_1$ having greater inclination rising to the right in the nozzle characteristic is smaller in the influence exerted on the thrust by the inclination of the pump head as compared with the curve $J_2$ having smaller inclination. This is because the gradient rising to the right of the nozzle characteristic $J_1$ is steep due to the excessive resistance. Consequently, in the jet propulsion system with the nozzle diameter having such nozzle characteristic, even if the characteristic of the pump head is flattened, the propulsion efficiency can not be so much increased, and it can be applied only to a ship smaller in the resistance of the hull.

In the jet propulsion system using a mixed-flow or axial-flow pump based on conventional design methods, when it is provided so as to have the nozzle characteristic $J_2$ with the delivery nozzle having greater diameter, the efficiency of the pump falls sharply along with the increase in the flow rate of the pump as shown in FIG. 6, the point of operation of the system comes to the side of excessive flow rate beyond the maximum point of pump efficiency, resulting in the likely occurrence of cavitation, and the excessive greater specific speed in pump design specification makes it possible only to set the nozzle characteristic greater in the gradient rising to the right as in the curve $J_1$, which makes the improvement of the efficiency of propulsion difficult. On the other hand, it has been theoretically confirmed that setting the ratio $V_j/V_s$ of the speed $V_j$ of the water jet to that $V_s$ of the ship so as to exist between 1.0 to 2.0 is better to improve the propulsion efficiency of the system, and also from this point of view, in the case of nozzle characteristic $J_1$ greater in the gradient rising to the right as mentioned above, the improvement of the propulsion efficiency can not be achieved because of excessively greater speed ratio.

It is apparent from the above-mentioned two reasons in higher revolution of pump (the pump and nozzle characteristics) that the improvement of the propulsion efficiency can not be effected with the water jet propulsion system using conventional design methods for turbo pump. On the contrary, in the water jet propulsion system having the impeller according to the present invention, the abovementioned drawbacks of the conventional design standards are eliminated, so that the considerable improvement of the propulsion efficiency of the system can be effected.

Figure 11:
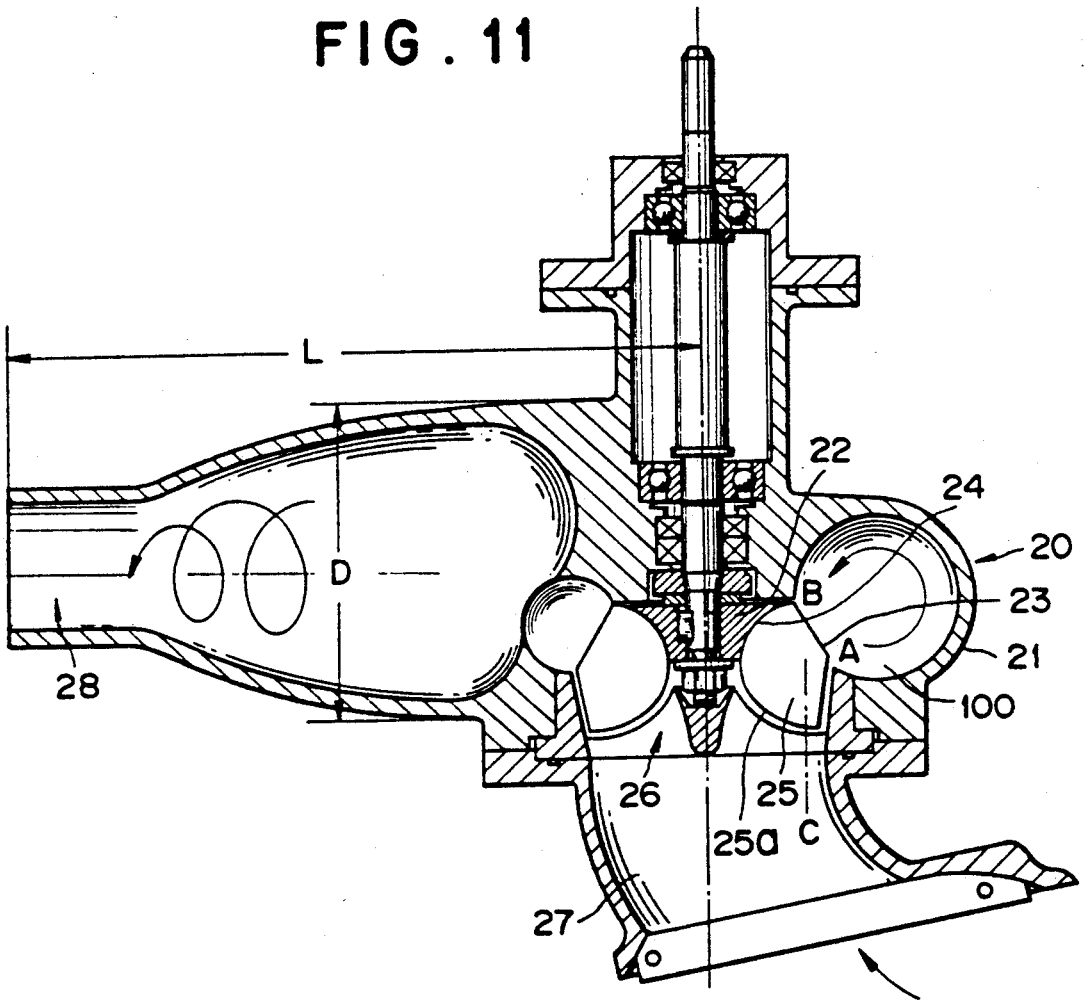
FIG. 11 is a longitudinal sectional view of a water jet propulsion system in which the turbo pump including the impeller according to the invention is used as a water jet propulsion machinery.

In the turbo pump having the impeller of the invention, a stationary inlet guide vane means according to the invention can be further provided immediately before the inlet of the impeller, for example as shown at 26 in FIG. 11.

Figure 8:
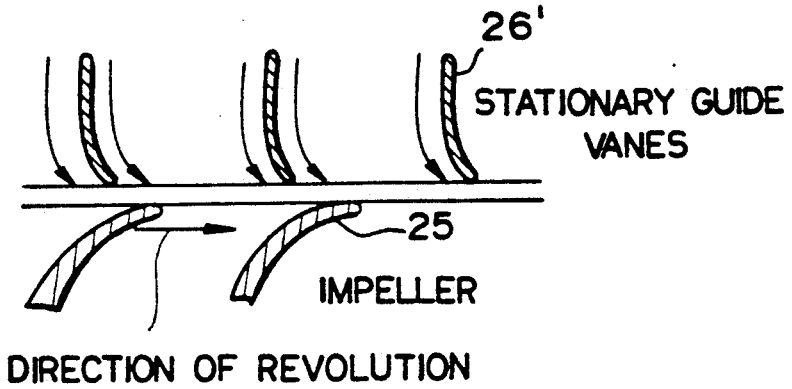
FIG. 8 is a development of a stationary inlet guide vane means of the normal pre-rotation type according to the invention.
Figure 9:
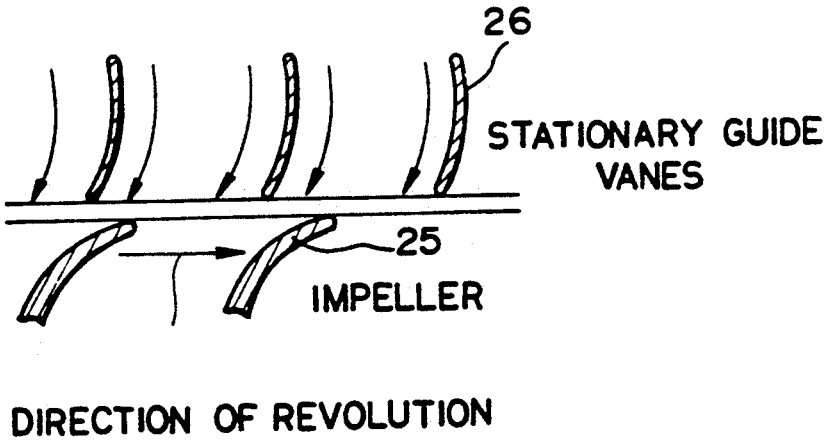
FIG. 9 is a development of a stationary inlet guide vane means of the opposite pre-rotation type according to the invention.

For this stationary inlet guide vane means, two types are considered, one being shown in FIG. 9 in the form of opposite forced prerotation type guide means which is shown in development of an impeller 25 and a stationary inlet guide vane means 26 along the circumference of a chain line C shown in FIG. 11, and the other being shown in FIG. 8 in the form of normal forced prerotation type guide means which is similarly shown in development of the impeller 25 and the stationary guide vane means 26'. Such stationary inlet guide vane means is provided immediately before the blade in order to eliminate the collision of the flow against the impeller 25 at the blade inlet and to smoothly introduce the flow of the water into the blade inlet since the higher speed of the impeller causes the greater inlet velocity $U_1$. The provision of the stationary inlet guide vane means permits the loss in inflow at the blade inlet to be made smaller to thereby effect the improvement of the characteristic of the pump, with the result that the increase in the jet propulsion may be brought about.

Figure 10:
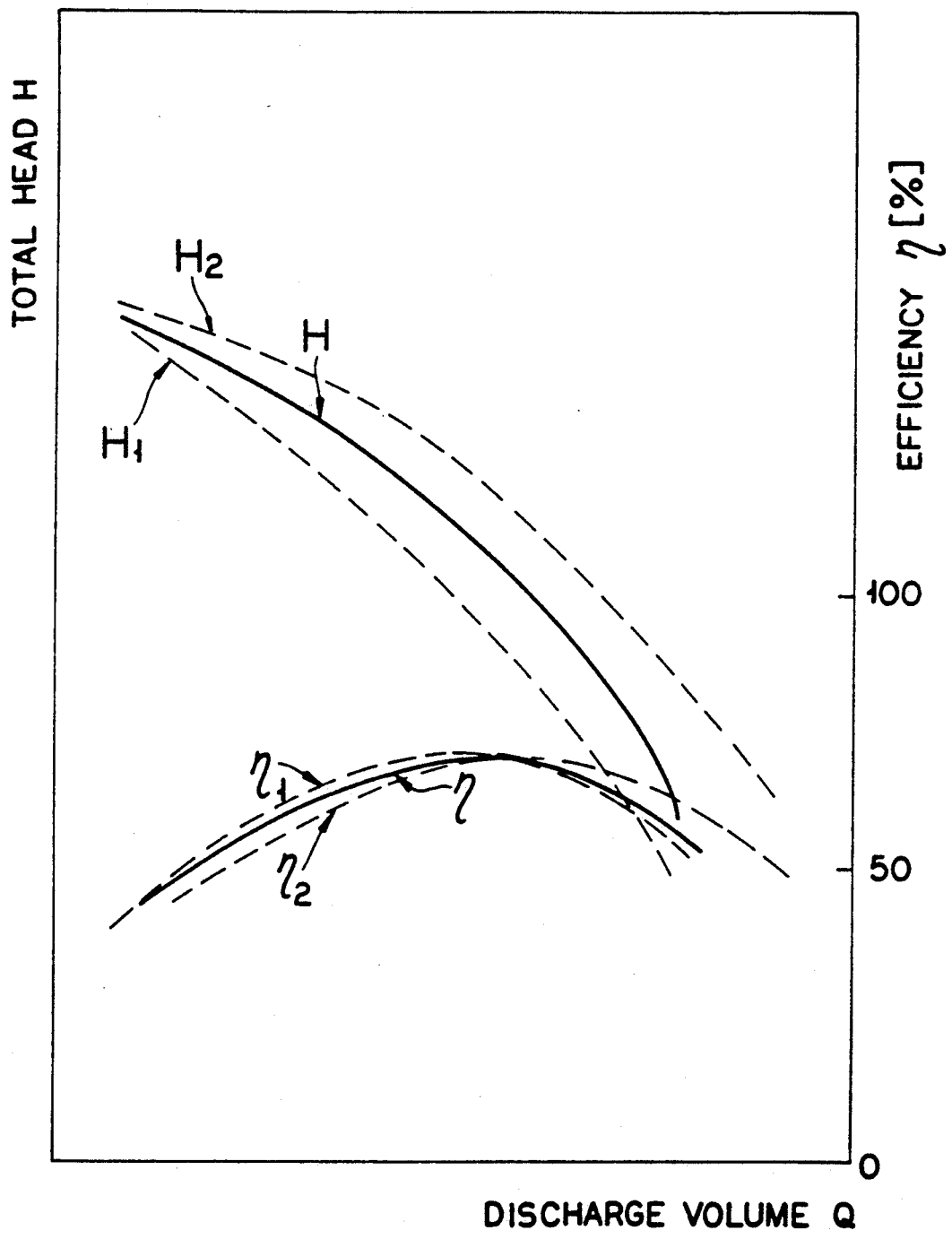
FIG. 10 is a graph indicating the characteristics of the pump, which are improved by providing the stationary inlet guide vane means for effecting the respective forced pre-rotation in the normal and opposite directions.

As shown in FIG. 9, the opposite forced prerotation type guide means 26 is of such construction that each of the rectifying plates of the stationary guide vane means 26 is made of sheet and slightly curved so as to introduce the flow into the blade inlet immediately before the inlet of the impeller in the direction opposite to that of revolution of the impeller, thereby effecting the conversion of the direction of the flow. It is recommended that the curvature of each of the rectifying plates is made greater in the central portion thereof and smaller in the outer peripheral portion, so as not to cause any resistance to the flow of the water at the suction portion of the pump and deteriorate the performance thereof. Such opposite prerotation effected immediately before the inlet of the impeller makes it possible to increase the quantity of the water pumped by the pump in a range of excessive flow rate beyond the maximum efficiency point of the pump, so that as shown in the graph of FIG. 10, the original basic characteristics H and $\eta$ vary as in the course of the characteristics $H_2$ and $\eta_2$, to thereby improve the head characteristic curve of the pump falling to the right as in the case of the jet of the nozzle with greater diameter as mentioned above and increase the propulsion of the jet as mentioned above, thereby effecting the improvement of the efficiency of the propulsion. Furthermore, the uniformization of the condition of the flow immediately before the impeller of the pump is considerably important to stabilize the pump characteristic to enhance the efficiency. Without the stationary inlet guide means, it is generally extremely difficult for a jet pump to keep the flow to the blade inlet of the pump uniform, however the provision of the stationary inlet guide vane means permits the jet pump to function to usually keep the flow to the blade inlet uniform.

FIG. 8 is a view illustrating a conception for rectifying the flow to the normal flow, and this type of stationary guide vanes produces the normal prerotation to thereby rectify the drawn flow to the same direction as the rotation of the impeller. In that case, the characteristics of the pump vary as shown by the characteristics of $H_1$ and $\eta_1$ in FIG. 10, and the lowered head of the pump can be achieved, so that the higher rotation of the pump can be effected, and the efficiency of the pump in the range of lower flow rate can be improved. Therefore, the pump provided with the stationary inlet guide vane means of the normal pre-rotation type is appropriate for superhigh speed water jet pump. In this way, the direction of the flow at the stationary guide vane provided in the inlet of the impeller, the angle of change in the direction of the flow, the dimensions of curvature of the rectifying plates, the axial length of the stationary guide vane, and so forth may be appropriately predetermined depending on the resistance to the ship, the required speed thereof and the number of revolution of the engine (that of the pump), and the provision of the rectifying means immediately before the blade inlets permits the increase in the efficiency of the propulsion to be effected.

In the turbo pump according to the invention, when using a volute casing type, the form of the casing to a nozzle provided at the outlet thereof, greatly affects the generation of the thrust or the efficiency of propulsion. Particularly, in the case where the discharge quantity of the pump is set to higher flow rate (when taking such a nozzle characteristic as shown by the curve $J_2$ in FIG. 7) as in the use of the impeller of the present invention, the increased quantity of the water jet causes rotation of the jet flow from the nozzle, so that it can not be effectively converted into the thrust of the jet. This is caused because the blade outlet is provided in the form of mixed flow in a relation inclined to the rotary shaft of the pump, as shown by a line A-B in FIG. 11, in order to provide the lower head at a higher speed when the pump is directly coupled to an engine.

FIG. 11 shows a turbo pump 20 which has a volute casing for a water jet propulsion machinery used as propulsion means for ships. In the pump, an impeller 23 of the mixed-flow type in the form of the blade outlet according to the invention is secured to the end of a rotary shaft 22 extending into the volute casing. The impeller 23 includes a shroud 24 at the side of a boss having a surface of revolution consisting of a concave arc-like curve in the configuration of meridian section according to the invention as described above, and a plurality of blades 25 in the aforementioned form arranged on the shroud 24. A stationary inlet guide vane means 26 is secured to the volute casing 21, adjacent to the impeller edges **25*a* of the blade inlets, and a suction pipe 27 is provided upstream to the guide vane means 26. A discharge nozzle 28 is provided in the outlet of the volute casing 21**.

Figure 12:
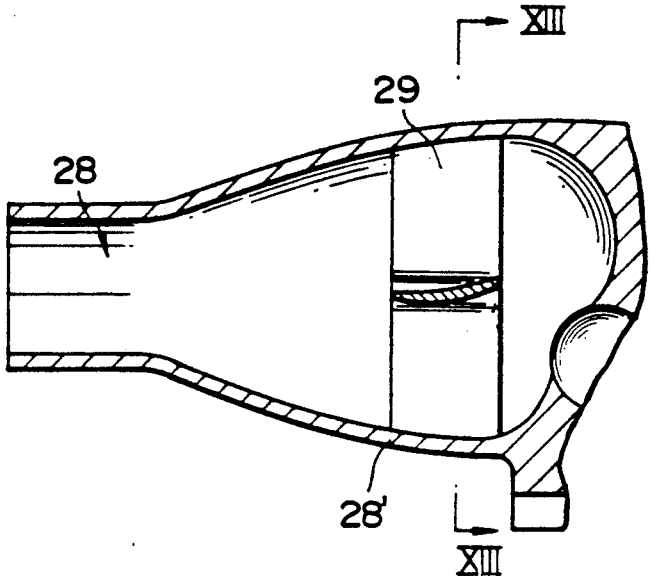
FIG. 12 is a partial sectional view of a rectifying plate provided in a throst of a volute casing of the water jet propulsion system shown in FIG. 11.
Figure 13:
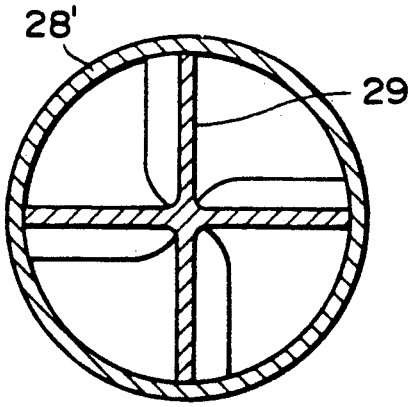
FIG. 13 is a cross-sectional view of the water jet propulsion system taken along the line XIII—XIII shown in FIG. 12.

Since the outlet of the impeller 23 of the turbo pump 20 is in the form of mixed-flow, it causes a pressure difference between points A and B, so that a rotational flow is produced in the volute casing 21 as shown by an arrow in FIG. 11. Such rotational flow increases in violence, which affects to the flow of the jet water to cause the drop of the thrust. This phenomenon may be prevented by increasing diameter D and length L of the volute, however while the higher speed due to the direct coupling of the pump with the engine permits specially the compact design of the pump, the volute casing is extremely enlarged at the outlet portion, which has an evil influence of obstructing the design of the pump smaller in size and lighter in weight. According to the present invention, as shown in FIG. 12, a flow rectifier 29 is provided as outlet guide means in the throat 28' of the volute casing 21 in order to prevent the drop of the thrust caused due to the rotational flow within the volute casing as mentioned above. This permits the diameter and length of the nozzle to be manufactured with the minimum dimension, thereby permitting the entire compact design. The form of the flow rectifier 29 may be similar to that of a diffuser at the outlet of an axial flow pump, as shown in FIGS. 12 and 13. It is added that the stationary vane shown in FIGS. 12 and 13 is only one embodiment, and the configuration and number of the stationary vanes are optional and should not be limited to the embodiment shown in the drawings.

Figure 14:
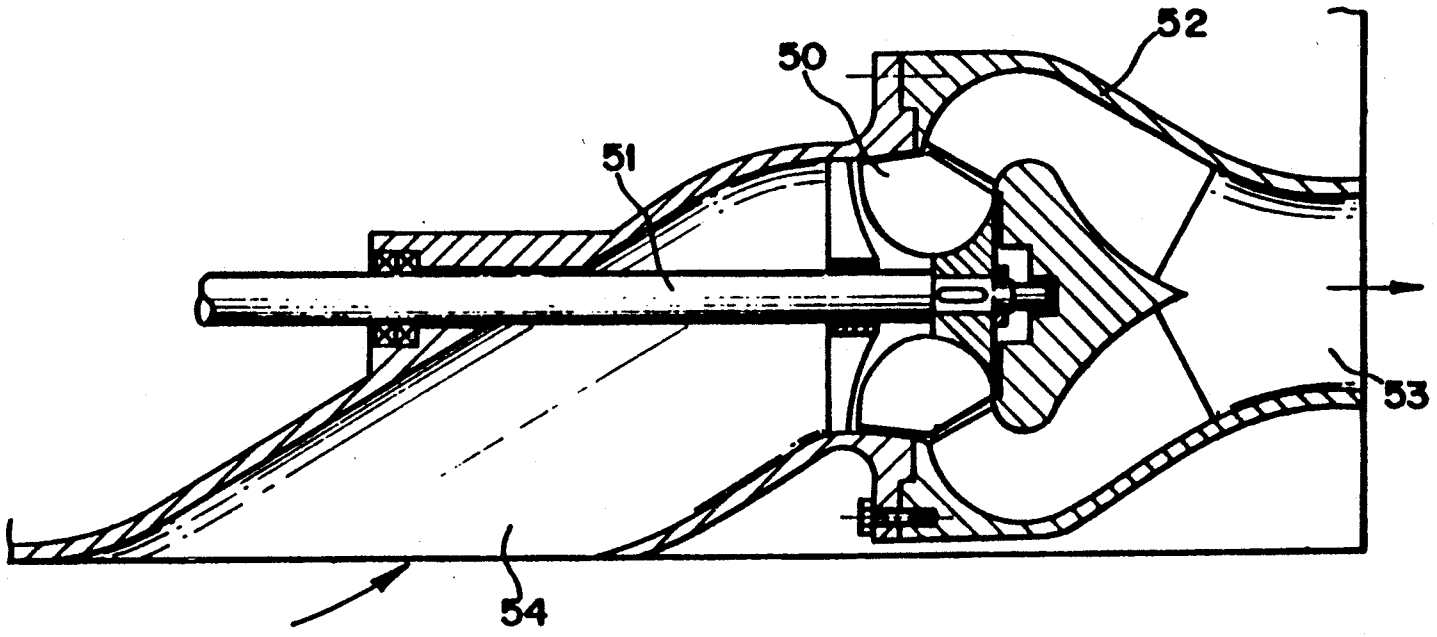
FIG. 14 is a fragmentary sectional view illustrating a diffuser-type casing provided adjacent to the blade outlet of the turbo pump in a water jet propulsion system for ships.

The impeller according to the invention has been explained with regard to the turbo pump for the water jet propulsion machinery used as propulsion means for ships having the spiral volute casing, however it can be also applied to a turbo pump used as propulsion means for ships having a diffuser-type casing as shown in FIG. 14. 50 designates the impeller according to the invention shown in FIGS. 4 and 5, fixedly secured to a rotary shaft 51, 52 a diffuser type casing adjacent to the blade outlet of the impeller 50, 53 a discharge nozzle and 54 an intake port.

As stated above, the gist of the invention has been described with regard to the water jet propulsion machinery used as propulsion means for ships, however the invention can be also applied to a high-speed pump for general purpose in the industry, since it is basically a technique for higher speed of the pump.

Figure 16:
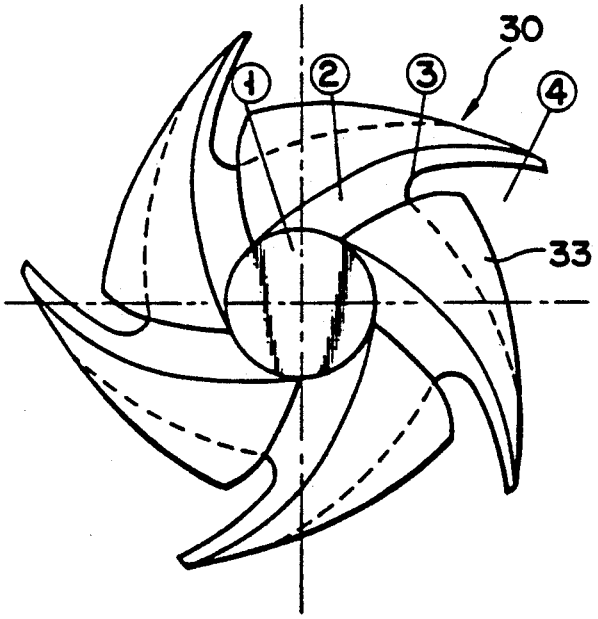
FIG. 16 is a front view of the impeller shown in FIG. 15.
Figure 17:
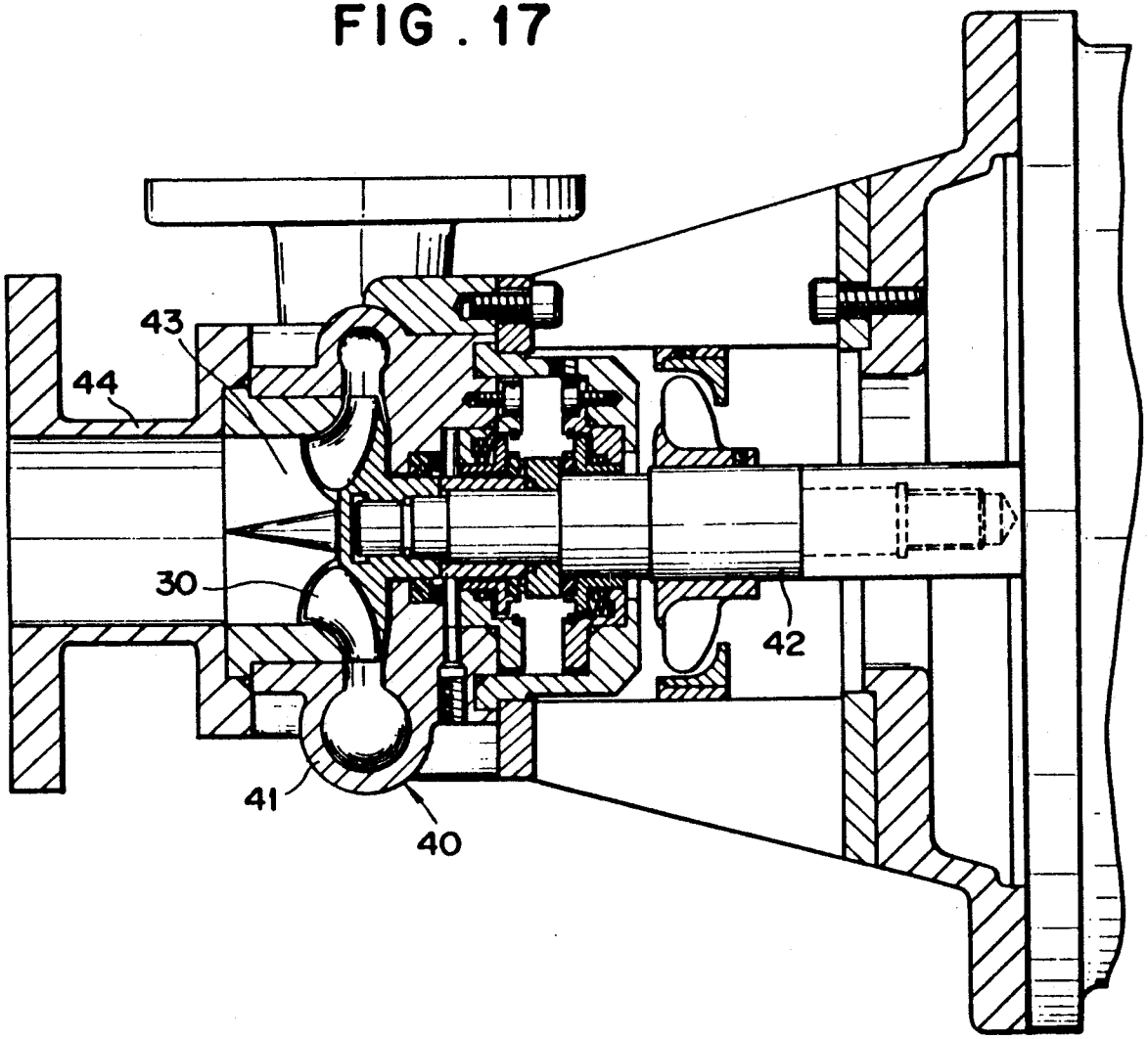
FIG. 17 is a longitudinal sectional view of a turbo pump for general industry, taken along the axis thereof, which includes the impeller shown in FIG. 15.

A pump 40 shown in FIG. 17 includes an embodiment of use of the impeller 30 having the blades according to the invention shown in FIGS. 15 and 16. This type impeller is suitable for a superhigh speed ship in the water jet propulsion system. In this case, since the head of the pump is higher, the load on the bearings thereof due to hydraulic thrust of an impeller would be too high to operate the pump at a higher speed unless it is designed to reduce the thrust of the shaft thereof. For that reason, the impeller 30 shown in FIGS. 15 and 16 has blades 33 arranged on a shroud 32 of a boss 31 having a surface of revolution as a concave curve, said impeller being formed as open type one with the shroud 32 in the form of star cut out in the portions between the blades. The profile of each of the blades 33 is described as a meridian section illustrating the configuration of the section of each blade taken along the lines of ①~④ similarly to FIGS. 5 and 4. In the turbo pump 40 shown in FIG. 17, the impeller 30 according to the invention shown in FIGS. 15 and 16 is secured to an end of a rotary shaft 42 in a volute casing 41, a stationary inlet guide vane means 43 is fitted in the inlet side of the casing adjacent to the impeller 30, and a suction pipe 44 is secured upstream to the guide vane means. In order to design the smaller sized casing, stationary guide vanes are preferably provided in the volute throat.

Table 1 shows design factors in the case the above-mentioned turbo pump is used.

TABLE 1

| | |
|---|---|
| Number of revolution of pump Rating | 8,000 r.p.m. |
| Number of revolution of pump Maximum | 10,000 r.p.m. |
| Motor | 22 kw |
| Diameter of blade; Number of blades | 90 mm; 5 |
| Width of outlet | 13 mm |
| Specification of pumped liquid | High-temperature viscous liquid 130° C., 2,000 cp Specific gravity 1.2 |
| Specification | 600 l/min. × 70 m × 8000 r.p.m. |

TABLE 1-continued

| | |
|---|---|
| Efficiency of pump | 65% |

Figure 18:
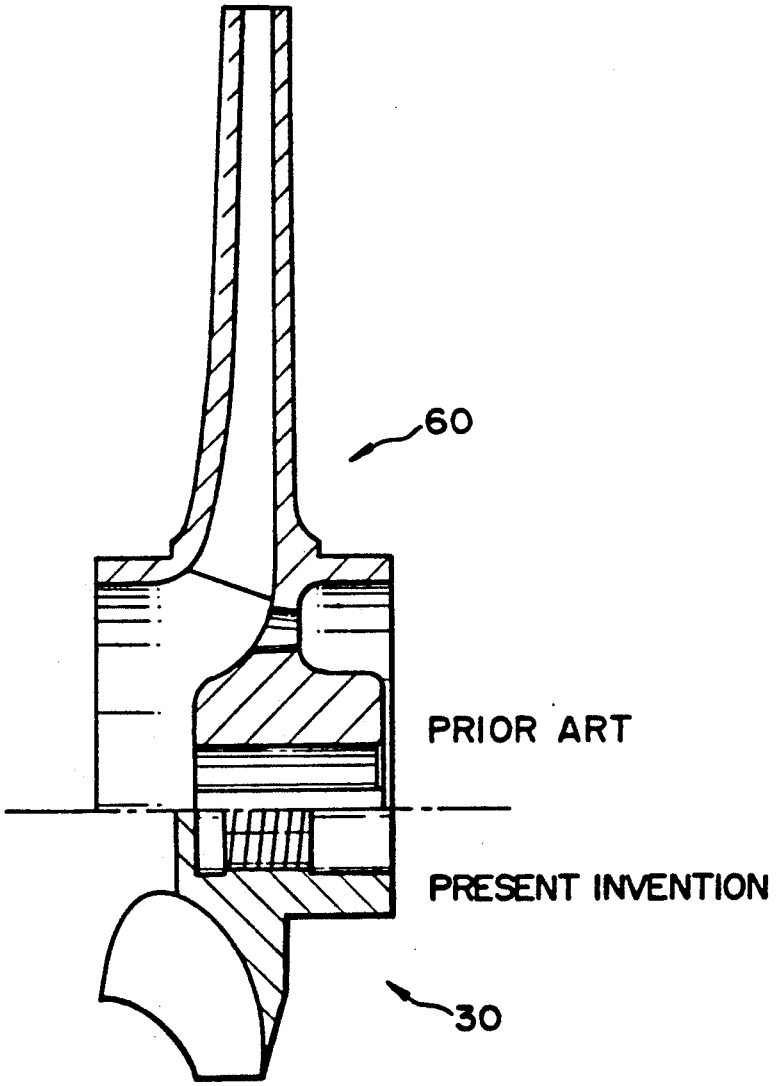
FIG. 18 is a sectional view illustrating, for comparison, a meridian section of a single-stage pump impeller designed conventionally and that of the invention, either of which meet the same pump specification but differ in revolution.

FIG. 18 illustrates a meridian section of the impeller 30 of the invention and that of an impeller 60 of a conventionally designed single stage pump for lower revolution, both of them satisfy the same pump specification (flow rate, head). As apparent from FIG. 18, in the impeller 60 of the conventionally designed single stage pump, the passage is narrower, and therefore for delivery of high viscous liquid like an example shown in Table 1, a boundary layer is greatly developed in the impeller, which results in considerably greater hydraulic loss of the pump and also greater frictional loss in the disks. As a result, the conventional single stage pump requires extremely greater power and the delivery of such high viscous liquid is actually impossible. On the other hand, in the impeller 30 which makes the higher speed possible according to the invention and which has solved the problems of the pump impeller attended by the higher revolution thereof, the greater width of the passage and the smaller diameter of the impeller enables the hydraulic loss and the power of the frictional loss in the frictional loss in the disks to be remarkably reduced as compared with the impeller according to the conventional design standards, so that the performance of the pump can be greatly improved and the delivery of the high liquid viscous can be achieved. Furthermore, the turbo pump having the impeller according to the invention permits not only the thickness of the casing to be designed thinly owing to the smaller size of the pump despite the high pressure produced, but also the conduction of heat to the motor and the bearings in the delivery of liquid of higher temperature to be prevented without the need of water cooling the bearings and the like by a simple cooling fan provided between the pump and the bearings (motor), thereby providing the simple construction of the pump. When the pump according to the invention is used as a high-speed type turbo pump for general purpose in the industry, the delivery of liquids is possible in a range wherein the delivery of the liquids could not have been achieved by the conventional centrifugal pumps, the space for installation is smaller owing to the smaller and lighter pump, an accessory unit such as a water cooling unit is not required, and the output (capacity and head) of the turbo pump can be freely varried by controlling the number of revolution of the pump. The turbo pump according to the invention thus has inmeasurable utility value.

What is claimed is:

1. A turbo pump comprising:

a casing, a rotary shaft and an impeller mounted on said shaft;

said impeller comprising a central boss, a shroud attached to said central boss, a plurality of blades each of said blades having a continuous inlet edge defining an inlet for said impeller and extending from said shroud toward said casing, and an outlet;

wherein a meridian section of said shroud comprises a concave arc-like surface of revolution, said surface being cylindrical in form and substantially parallel to said shaft near said central boss;

each of said blade inlet being configured with said continuous inlet edge being smoothly connected to said shroud at said blade inlets to avoid sharp corners between the blades and shroud, said continuous edge, at said casing extending substantially perpendicular to said shaft, said continuous inlet edge at said shroud and said casing being connected by a smooth arc-like curve projecting convexly upstream, with the inlet angle of said continuous inlet edge being uniform through its length and substantially equal to 0°;

the configuration of each blade at the blade inlet being connected by a smoothly curved surface to the blade outlet.

2. The turbo pump in accordance with claim 1 wherein each of said blade outlets extends parallel to said shaft.

3. The turbo pump in accordance with claim 1 wherein each of said blade outlets extends inclined to said shaft.

4. The turbo pump in accordance with claim 1 wherein said casing is volute.

5. The turbo pump in accordance with claim 1 wherein said casing is of a diffuser type.

6. An impeller for a turbo pump for use in water jet propulsion for ships, said impeller comprising a central boss, a plurality of blades, each of said blades having a continuous inlet edge defining an inlet for said impeller, and extending from said boss toward a casing, and a blade outlet;

and a shroud attached to said central boss, wherein a meridian section of said shroud comprises a concave arc-like surface of revolution, and wherein said shroud at said blade inlets is cylindrical in form and substantially parallel to a shaft for said impeller;

each of said blades being formed so that said continuous inlet edge is smoothly connected to said shroud wherein said continuous inlet edge at said casing extends substantially perpendicular to said shaft, said continuous inlet edge at said shroud and said casing being connected by a smooth arc-like curve projecting convexly upstream, and wherein the inlet angle of said continuous edge is uniform through its length and substantially equal to 0° each blade further including a smoothly curved surface extending from said blade inlet to said outlet.

* * * * *